United States Patent [19]

Gustavsson

[11] Patent Number: 4,712,277

[45] Date of Patent: Dec. 15, 1987

[54] METHOD AND APPARATUS FOR PRODUCING A CONTINUOUS WEB

[75] Inventor: Lennart Gustavsson, Växjö, Sweden

[73] Assignee: Fläkt AB, Nacka, Sweden

[21] Appl. No.: 937,562

[22] Filed: Dec. 3, 1986

[51] Int. Cl.[4] ..... D01H 5/00

[52] U.S. Cl. ..... 19/296; 19/304

[58] Field of Search ..... 19/296, 300, 302, 304

[56] References Cited

U.S. PATENT DOCUMENTS

| | | | |
|---|---|---|---|
| 2,810,163 | 10/1957 | Kyame et al. | 19/107 X |
| 3,071,822 | 1/1963 | Meiler | 19/302 X |
| 4,099,296 | 7/1978 | Gustavsson | 19/304 |
| 4,662,032 | 5/1987 | Thorbjornsson | 19/300 |

*Primary Examiner*—Louis K. Rimrodt

*Attorney, Agent, or Firm*—Dann, Dorfman, Herrell and Skillman

[57] ABSTRACT

A method and apparatus for producing a continuous web of material (36) on an endless belt (24). Fibers suspended in a carrier gas are transported from a transport conduit (12) through a transition part (38) of zigzag configuration, having cross-section which tapers or narrows in the flow direction. Arranged at the outlet aperture of the transition part is a coarse-particle separator means (22) which incorporates a curved, convex surface (60), an accept outlet (48), and a reject outlet (54). The carrier gas is deflected around the convex surface, as a result of the ensuing Coanda Effect, and transports acceptable fine fibers to the accept outlet (48), while coarse reject particles, due to their greater kinetic energy, pass in a straighter path to the reject outlet (54). The accept outlet leads directly to a distribution chamber (52) which is located above the endless belt (24), and opposite which there is provided a suction box (32) for extraction of the carrier gas.

22 Claims, 9 Drawing Figures

METHOD AND APPARATUS FOR PRODUCING A CONTINUOUS WEB

FIELD OF THE INVENTION

The present invention relates to a method for producing a material web from acceptable fibrous material which is suspended in a carrier gas along with reject material. In particular, the invention relates to an improved method by which acceptable fibers are separated from the reject material and the carrier gas so as to be deposited on a movable belt to form a web. The invention also relates to apparatus for producing the web in accordance with the method.

BACKGROUND OF THE INVENTION

Several methods are known by means of which a web can be produced by depositing a gaseous suspension of fibers or other particles onto a continuous web-forming belt. For example, U.S. Pat. No. 3,071,822 describes a method in which the fibers are deposited through the intermediary of an oscillating nozzle, which is caused to traverse backwards and forwards across the belt with the aid of mechanical devices. This arrangement is encumbered with a number of drawbacks. The oscillating frequency of the nozzle is restricted to about 1–2 oscillations per second. It is difficult to achieve suitable oscillatory movement that will provide uniform distribution of material over the continuously moving web-forming belt.

U.S. Pat. No. 4,099,296 describes another arrangement which comprises a distribution chamber and a nozzle assembly which discharges into the chamber. The nozzle assembly has an elongated aperture which extends in the longitudinal direction of the forming belt. Arranged on at least one side of the nozzle assembly is a supply means having openings or jets which face the incoming stream of fibers and through which there is delivered pulsed jets of steering gas, the pulses of which are variable. The incoming stream of fibers is subjected to powerful impulses from the steering jets, which disperse the fibers, or material, throughout the distribution chamber in the form of fiber curtains, which are deposited onto the continuously moving belt or like carrier surface. The frequency at which the steering jets change the direction of the fiber stream is higher than in the case of the mechanical arrangement, e.g. from 5 to 15 times per second.

U.S. Pat. No. 4,197,267 is an improvement on the method of the above-mentioned patent and describes a particularly advantageous arrangement for achieving uniform distribution of the fibers, or material, issuing from the nozzle. This is effected by causing the flow of material to pass a zig-zag transition zone located upstream of the nozzle, as seen in the flow direction, and diverging towards the nozzle. The transition zone increases in area in a direction towards the nozzle, therewith resulting in a velocity decrease of the incoming flow of material. Passage of the material flow through the zig-zag transition zone results in uniform distribution of the material in the longitudinal direction of the nozzle.

The arrangements described and illustrated in the aforementioned patents have been found very effective and provide excellent results with respect to the uniformity of the web formed and the general quality of the web. The arrangements, however, do not provide the same good results when producing very thin webs having density below 500 g/m$^2$, and particularly densities below 400 g/m$^2$. Webs of uneven thicknesses are obtained at such low densities. In addition, thick regions are formed, presumably due to the fact that fiber bundles are created as the fibers are conveyed to the nozzle, and to the actual distribution chamber. Furthermore, fiber coatings which form on the walls of the distributing chamber are liable to loosen and fall onto the formed web. A milling operation is undertaken in the case of thicker webs.

SUMMARY OF THE INVENTION

Consequently, it is an object of this invention to provide an improved method for producing a material web of low density at high belt speeds with uniform material distribution to achieve uniform web thickness over the width of the belt without pronounced material agglomerations, and to improve generally the technique of producing webs of material, through the deposit of material onto one surface of a gas-permeable carrier from a gaseous suspension by means of suction applied at the opposite surface of the carrier. Another object of the invention is to provide apparatus for carrying out the method.

More specifically, the present invention contemplates the control of the flow of the suspension prior to the deposit of the material so as to separate the reject material from the acceptable fibrous material to be used for forming the web to thereby avoid coarse particles and fiber agglomerates.

The invention is characterized by the use of a convex surface confronting the flow of the suspension to enable the use of the Coanda Effect to achieve classification of the particulate material in the suspension, and enabling separation of the reject material therefrom.

In accordance with the invention, the separation is enhanced by employing a cylindrical surface as the convex surface and rotating the same about its cylindrical axis in the direction of flow of the suspension, preferably with a surface speed approximating the flow velocity.

Another feature of the invention provides for enhancing the uniformity of the web by introducing thinning air into the suspension across the width of the flow path in varying amounts to render the density of the suspension in the flow path more uniform across its width and also varying the suction effect applied to the opposite surface of the gas-permeable carrier across its width.

BRIEF DESCRIPTION OF THE DRAWINGS

The invention will now be described in more detail with reference to a non-restrictive exemplifying embodiment thereof illustrated in the accompanying drawings, in which.

DESCRIPTION OF THE PREFERRED EMBODIMENTS

Figure 1:
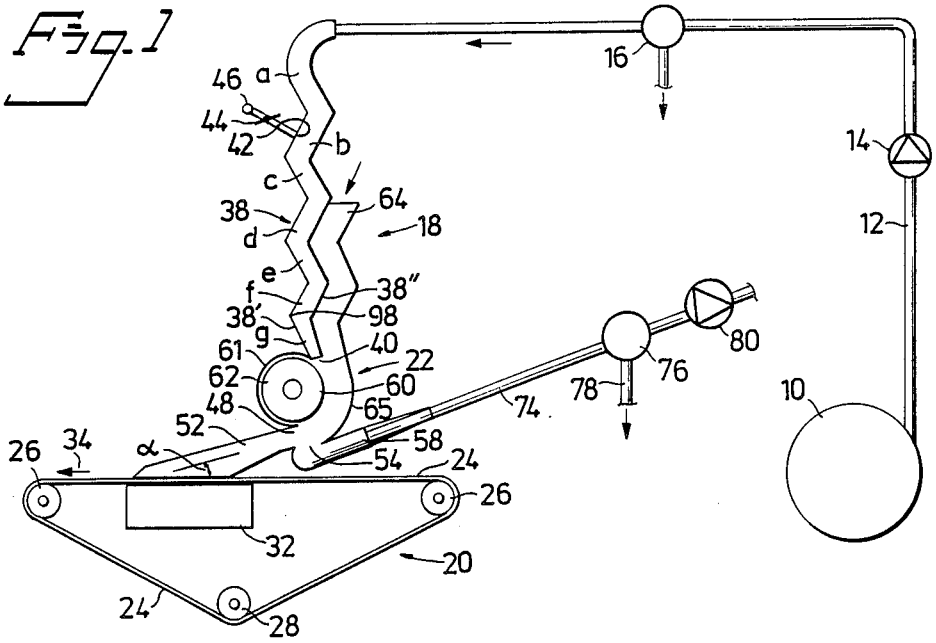
FIG. 1 diagrammatically illustrates a plant for producing a web of material and incorporating apparatus according to the invention.
Figure 2:
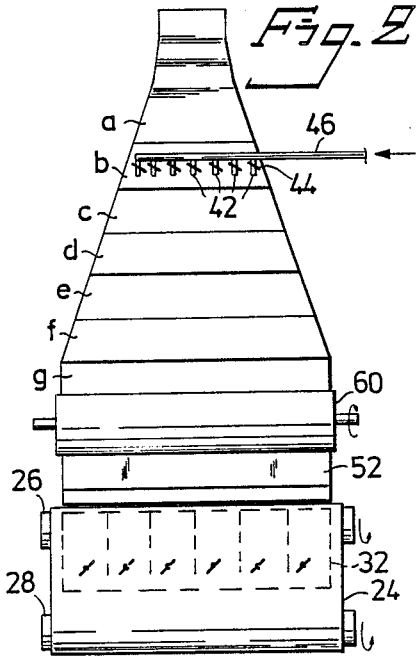
FIG. 2 is a front view of a web-producing machine included in the plant of FIG. 1 and incorporating separator means embodying the invention, seen from the outlet side.
Figure 3:
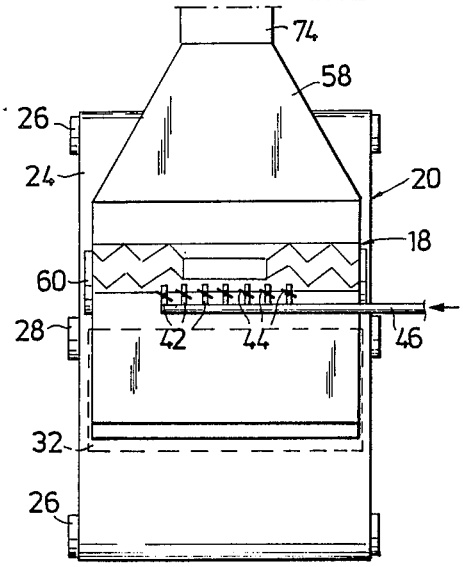
FIG. 3 is a view of the machine of FIG. 2 from above.

In FIG. 1 there is illustrated of apparatus for producing a material web, comprising a preparatory station 10 (not described in detail) for producing or dispensing fibers; a transport conduit 12 for transporting fibers suspended in a gaseous medium; a blower 14 for effecting said transport; a symbolically illustrated pre-separator 16 for separating coarse particles; distribution and delivery apparatus 18, and a web forming machine 20. The distribution and delivery apparatus 18 incorporates a transition part 38 leading into a separator 22 which separates fiber-bundles and coarse particles from the suspension immediately prior to the delivery thereof to the web-forming machine 20. The machine 20, of which only those components that are active in the process have been shown, comprises an endless, gas-permeable belt or wire 24, two terminal rollers 26, at least one bottom roller 28, screen means in the form of transverse rods or a perforated plate 30 (FIG. 4) underlying and supporting the wire 24, and a suction box 32. The wire is arranged for movement in the direction of the arrow 34. A web 36 formed on the machine 20 is transferred therefrom to other machines, not shown, for continued treatment. The machine 20 may incorporate more than one distribution and delivery apparatus 18 with associated suction box. This will enable a thicker web to be produced, or a web comprising various layers of material.

The distribution and delivery apparatus 18 incorporates a zig-zag or sinusoidal transition part 38 having an outlet aperture 40 which is transverse to the endless belt or wire 24. The transition part 28 comprises a series of interconnected sections a through g which together form the aforesaid zig-zag configuration and the interconnecting curves of which are substantially parallel to the outlet aperture 40. The sections increase in width from the inlet end of the transition part to the outlet and thereof, while decreasing in thickness at the same time, such that the total throughflow area presented effectively tapers in a direction towards the outlet aperture. This decreasing area results in an increase in the velocity of the fiber suspension as it passes through the transition parts. The section b has provided therein a plurality of ports 42 through which air is introduced into the suspension for the purpose of thinning the same, said inlet ports being provided with air intake shutters 44 connected to a common air supply conduit 46. Any irregularities in fiber dispersion in the incoming fiber suspension can be compensated for, by appropriate adjustment to the settings of the air intake shutters. For example, such irregularities may result from the particular geometry of the transport conduit 12 and may persist over a period of time. When such irregularities are noted, the intake shutters 44 may be adjusted to compensate for the same.

The aforementioned coarse particle separator 22 is located in the vicinity of the outlet aperture 40, and has an accept outlet 48 for fibers 50 which pass to a distribution chamber 52 located above the wire 24 and its suction box 32, and a reject outlet 54 for coarse fibers and fiber agglomerates 56, 57 connected to a collecting chest 58. The separator includes a curved, convex surface 60, which may comprise the peripheral surface of a drum 62 (FIGS. 1–4) arranged for rotation in the flow direction. According to an alternative embodiment in FIG. 7, the convex surface may comprise a stationary single surface 60*a*. In the embodiment of FIG. 8, the convex surface may comprise two curved surfaces 92 and 94. As will be seen from FIG. 1 of the drawing, one defining wall 38' of the transition section 38 terminates in the aperture 40 generally tangentially adjacent the convex surface 60. The other defining wall 38" of the section communicates with an air inlet opening 64 for recycled air and ambient air.

The separator operates in the following manner. The incoming fiber suspension is deflected along the curved surface 60, as a result of the so-called Coanda Effect. Thus, the fiber suspension follows an inner path 66 and leaves the separator through the accept outlet 48. Air moves from the air inlet 64 to the reject outlet 54, in an outer path 68 located externally of said inner path. Coarse particles 56 and fiber agglomerations have greater kinetic energy, due to their greater mass, and are therefore influenced to a lesser extent by the carrier gas of the fiber suspension. Consequently, this material of greater mass will move in a straighter path, through a boundary layer between the paths 66 and 68 as indicated by the phantom lines 70 to the outer path, and out through the reject outlet 54. As noted above, the center line of the flow path from the outlet aperture 40 of the transition parts is generally tangential to the surface 60, and the center line of the supplemental air inlet 64 is generally parallel to this outlet center line. Since the outer wall 65 has a curvature concentric with the curvature of the surface 60, the boundary layer 70 for the suspension flowing outwardly through the outlet 40 generally follows the curvature of the convex surface 60 at a distance spaced radially outward from the surface. It is noted that the circumferential distance of the outer path 68 between the inlet 64 and the outlet 54 is sufficiently great that any heavier particles following the tangential path of the suspension entering through the outlet 40 will traverse the boundary layer 70 and enter the outer path 68 towards the reject outlet 54. The relative flow quantities at the ends of the inner and outer paths 66 and 68 may be regulated by controlling the section applied through the accept outlet 48 by the section box 32 and through the reject outlet 54 by a fan 80, as described below. The lateral extent of the outer and inner paths, and thereby the separation limit of the separator, can be adjusted by changing the setting of an adjustable tongue or flap deflector 72 located between the accept outlet 48 and the reject outlet 54, whose free end is spaced radially outward from the accept outlet 48.

The reject outlet 54 leads to a collecting chest 58 for separated particles and agglomerates. The chest tapers down towards an outlet conduit illustrated diagrammatically at 74. The top angle is suitably about 60° or less. Two or more outlets are provided in the case of widths greater than about one meter. The outlet conduit 74 communicates with a separator 76 for solid goods which may be discharged as indicated at 78, and a fan, blower, or the like 80. The separated solids 78 may be returned to the preparatory station 10, or used in some other way, or may be dumped as waste, in accordance with prevailing circumstances.

Figure 6:
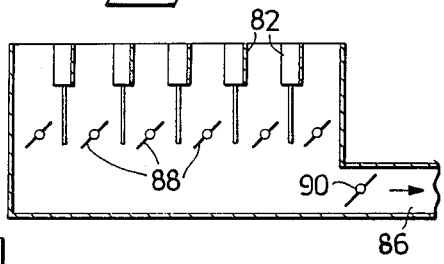
FIG. 6 is a cross-section view of the suction box illustrated in FIG. 5.
Figure 5:
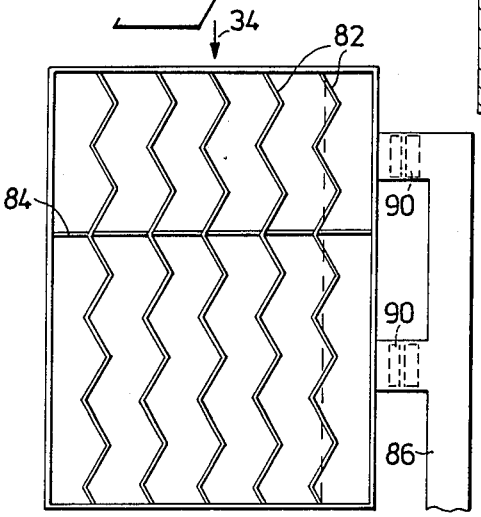
FIG. 5 is a plan view of a suction box incorporated in the machine of FIG. 2.

The fibers from the accept outlet 48 enter the distribution chamber 52 and disperse over the endless, perforated belt 24, the carrier gas being drawn by suction through said belt and into the suction box 32. As will best be seen from FIGS. 5 and 6, the suction box 32 is divided in the direction of its longitudinal axis by zig-zag shaped partition walls 82. The zig-zag shaped walls provide a diffuse boundary zone between the different suction boxes, therewith avoiding the occurrence of zones of lower suction effect, such zones being liable to result in an uneven web. Optionally, the suction box may also be divided in the movement direction 34 of the web 24, with the aid of one or more transverse walls 84. As shown in FIG. 6, the suction box 32 and suction outlet conduit 86 are each fitted with a respective valve means 88 and 90. Since the amount of fibers deposited above a suction-box section is dependent at least in part on the amount of gas drawn through the belt or wire, the profile of the web can be controlled to a certain extent with the aid of these valves. The valves can be adjusted manually or automatically to appropriate settings, subsequent to determining the thickness or density of the resultant web in a known manner.

In principle, it is endeavored to recycle all of the air from the suction box 32 and the fan 80, through the system in a closed circuit, so that all gas is returned to the distribution and delivery apparatus 18 and its associated separator 22. Excess air, resulting from air seepages into the system and possible intake of fresh ambient air through the inlet 64, is cleansed before being discharged to the surroundings.

The separation boundary of the separator 22 is contingent, inter alia, on the quantity and velocity of the gas in the various openings and apertures, i.e., the outlet aperture 40, the air inlet 64, the accept outlet 48 and the reject outlet 54. The settings of these air velocities is therefore an important operating parameter of the separator 22. Another important operating parameter is the setting of the adjustable flap deflector 72.

The gas increases in velocity as it passes through the transition part 38. Examples of gas velocities are:

Transport conduit: 20 m/sec.

Inlet end of the delivery apparatus 18: 25 m/sec.

Outlet aperture 40: 40 m/sec.

Higher and lower gas velocities are conceivable at the outlet aperture 40, however.

The curved, convex surface 60 is preferably caused to move in the direction of gas flow at the same speed as the velocity of the gas and the fibers suspended therein. Both lower and higher speeds are conceivable, however. The movable surface 60 of the illustrated embodiment comprises the peripheral surface of a drum. It may, however, alternatively have the form of a belt that is arranged to move around guide surfaces and guide rollers in a closed loop. Obviously, the surface 60 may have many different forms, although a drum is the embodiment preferred.

The advantages afforded by rotating the curved, convex surface 60 in the direction of the flow of fiber suspension resides in the fact that there is then no substantial deceleration in the gas flow due to surface drag in the proximity of said surface. This results in a stable, smooth and regular flow of suspension, due to large velocity gradients at various distances from the convex surface.

The dynamic forces have dominance over gravitational forces, when the separator 22 is in operation. Consequently, the zig-zag transition part 38 and the separator 22 and its outlets 48 and 54 can be orientated in any desired position relative to the vertical. This also applies to the distribution chamber 52. The angle alpha ($\alpha$) between the perforated belt 24 and the median line of the delivered fiber flow can be any desired angle. Thus, the angle can be much larger than the illustrated angle of about 20°, and may, for example, be 60° or even close to 90°, or greater than 90°.

Figure 4:
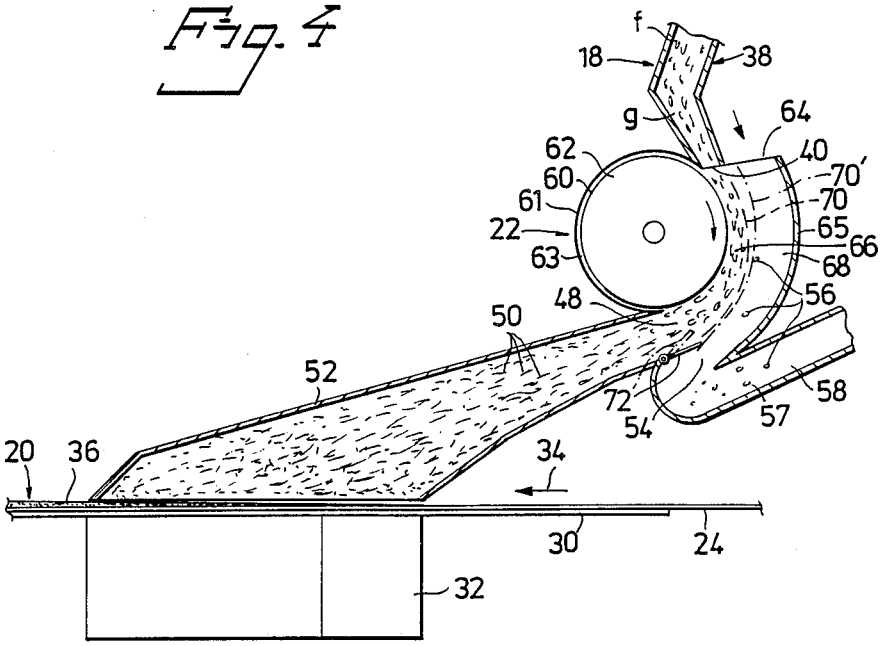
FIG. 4 is an enlarged fragmentary sectional view of the machine of FIG. 2, showing the separator means according to the invention.

In the embodiment illustrated in FIG. 1, the air inlet 64 has an outer wall which follows the zig-zag or sinusoidal transition part 38 along several of the transition curves in sections d through g. This is not a necessary requirement, however, since the outer wall of the inlet 64 may be omitted as shown in FIG. 4 so that air inlet 64 may also have an inlet opening which is located in the immediate proximity of the outlet aperture 40. In either event the opening 64 may be straight.

In the case of a separator means according to the invention, the flow of fiber suspension is caused to change direction at the region of the curved, convex surface 60 through an angle of 90°, so as to effectively separate coarse fibers, particles or other reject material from the flow. Directional changes smaller or greater than 90° are conceivable, however, depending on other operational variables, such as, for instance, differing gas velocities and the sizes of the various openings and apertures. The smallest change in direction in which coarse particles can be separated effectively under favorable conditions is thought to be 30°, however. The largest directional change is limited upwardly by the angle at which the air stress no longer adheres to said surface. This angle can be expected to be larger when the surface moves in the direction of the air stream.

The convex surface may also comprise two separate convex surfaces. In this regard, FIG. 8 illustrates an arrangement comprising a first convex surface 92 with a directional change of about 60°, and a second deflection surface 94 with a directional change of about 30°. The separator illustrated in FIG. 8 can also be used as a pre-separator, for example the pre-separator 16, as explained in more detail hereinafter. FIG. 8 also illustrates a preferred velocity profile or configuration 96 for the incoming fiber suspension. According to this velocity profile, the speed of the incoming suspension is greatest nearest the curved surface 92. The illustrated velocity profile is obtained in all of the embodiments of FIGS. 1, 7 and 8 by incorporating, at a location just upstream of the curved surface, a further curve or bend 98, **98*a*, or 98' curving in a direction opposite to the deflecting direction of the curved surfaces 60, 60*a* or 92. In FIG. 1, this further curve or bend 98 terminates the zig-zag shaped transition part 38** of said arrangement.

FIG. 4 illustrates in broken lines a boundary layer 70 which extends from the partition wall between the outlet aperture 40 and the air intake 64. The outgoing velocities, however, can also be selected so that a second boundary layer 70' extends into the air inlet 64 and curtains off a part of this air to the accept outlet 48. This separated airflow acts as a barrier, to prevent fibers of acceptable quality from passing across the boundary layer to the reject outlet. This migration of acceptable fibers can otherwise readily occur in the case of such fibers which are present in the outlet aperture, i.e, initially in the near vicinity of the air inlet 64 and the boundary layer 70.

In order to achieve a good separation effect, the convex surface 60 is given a radius of curvature in the order of magnitude of 15 cm, when the incoming velocity is 40 m/sec.

Figure 7:
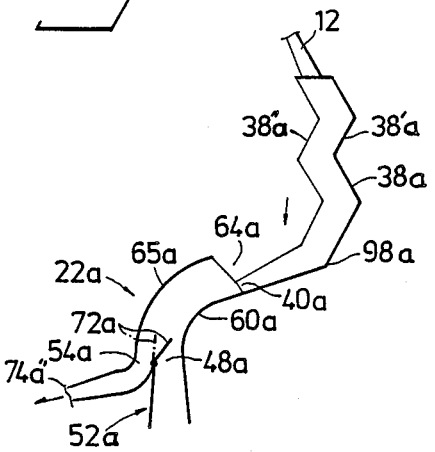
FIG. 7 illustrates an alternative embodiment of a separator means according to the invention.
Figure 8:
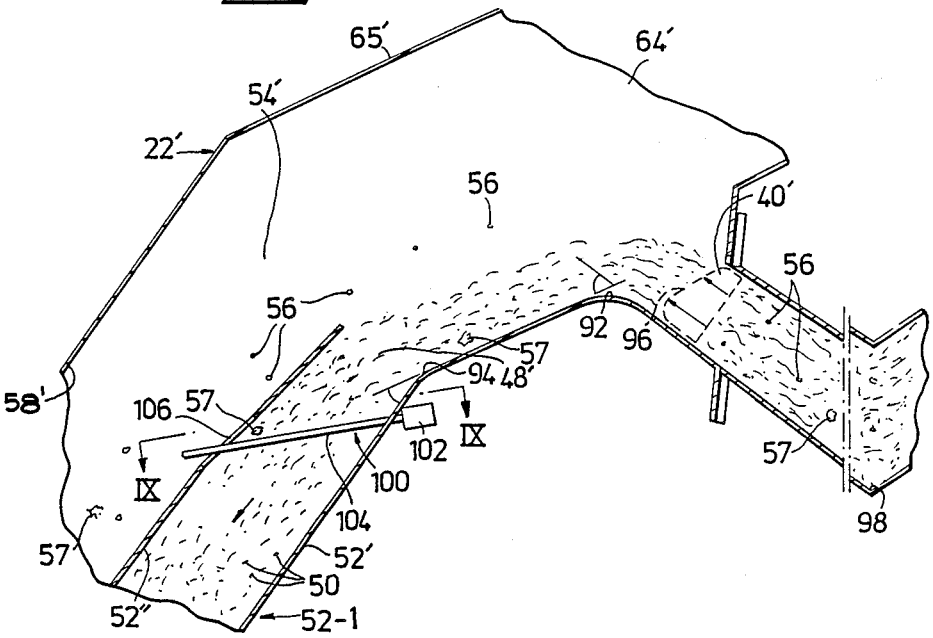
FIG. 8 illustrates a second alternative embodiment of a separator means.

FIG. 7 illustrates another embodiment of a separator, here referenced 22*a*, which incorporates a stationary curved surface 60*a*. Details and components of the FIG. 7 embodiment that coincide with the embodiment earlier described are identified by the same references suffixed with the letter a.

A further embodiment of the separator is illustrated in FIG. 8, and comprises the two aforementioned convex surfaces 92 and 94. This alternative separator, here referenced 22', incorporates an auxiliary separating or screening device in the form of a screening grid 100, which is intended to screen out lightweight bundles or fiber agglomerates 57 which may be carried in the suspension flow 50. As will best be seen from FIG. 9, the screening grid comprises a transverse beam 102 and rods or fingers 104 extending outwardly therefrom. The screen extends from one wall 52', through a passage 106 located in the opposite wall 52'' of the inlet of the downstream distribution chamber 52-1, such as to transfer coarse material to the collecting chest 58'. The screen 100 also forms a safety device in the event of operational disturbances.

Similarly to the separator 22, the separator 22' has a fiber suspension inlet 40', an air inlet 64', an accept outlet 48', and a reject outlet 54'. As with the aforedescribed embodiment, the reject outlet 54' opens into a chest 58' which is connected to a solid-product separator and a fan. The air inlet 64' is preferably connected to a source for recycled air, although it may alternatively be open to ambient air. As with the aforedescribed separator 22 having a rotating drum 62, the separator 22' of this embodiment may also have any desired position of orientation to the vertical, since the dynamic forces dominate over the gravitational forces.

Figure 9:
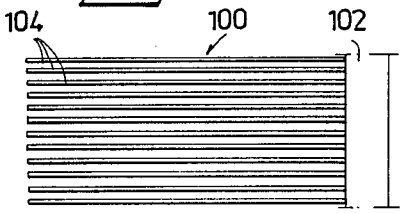
FIG. 9 illustrates a screen incorporated in the arrangement shown in FIG. 8.

A screening grid corresponding to that illustrated in FIGS. 8 and 9 can also be incorporated in the separator 22 with rotating drum 62 according to FIGS. 1 and 4.

Although not absolutely necessary, a pre-separator 16 advantageously may be arranged upstream of the distribution and delivery apparatus 18 of a web forming plant of the aforesaid kind. The function of the pre-separator is to effect primary separation of coarse particles and fiber agglomerates from the incoming fiber suspension. The pre-separator 16 may have any desirable form, and may also have the form of the aforedescribed separator incorporating a convex surface and utilizing the Coanda Effect.

Suitably, the distribution and delivery apparatus 18 has a maximum width of about 1 m. When the webs produced have widths greater than one meter, a plurality of distribution and delivery apparatus 18 are arranged adjacent one another, with a common distribution chamber 52. This enables the fibers to be dispersed evenly over the whole width of the web.

The arrangement according to the invention can be used to produce webs from any type of fiber. A preferred material, however, is cellulose-fiber and wood-fiber. Other conceivable fibers are natural textile fibers, synthetic fibers, carbon fibers, and mineral fibers (e.g. glass wool and mineral wool). One or more of these latter types of fiber can be used to enhance the mechanical strength properties or other properties of a cellulose-fiber or wood-fiber web. The fibers used may have a length ranging from a minimum length close to zero, up to about 15–20 mm.

When practicing the aforedescribed method, it is possible to produce webs having a density, or surface weight, below 500 g/m$^2$, and webs can be produced with a more uniform quality than has been possible with earlier techniques. Densities of about 50 g/m$^2$ can be produced by the dry forming method. This method is preferably used for densities between 100 and 400 g/m$^2$, and is particularly useful in producing paper of densities less than 300 g/m$^2$, which has not previously been possible with any satisfactory result.

The binders required to cement the material web can be introduced in a subsequent treatment stage, downstream of the machine 20, in a known manner. Alternatively, the binder may be mixed with the fiber suspension and dispersed together with the fibers.

The space defined by the drum 62 and a rearwardly lying housing wall 61 is preferably at most a narrow gap 63. It is particularly essential that the gap is narrow at its inlet end, in order to avoid air or fibers being entrained thereinto, which otherwise may cause operational disturbances. Operationally, a shield, for example in the form of a rubber flap or the like, may be fitted in front of the gap. The opposing wall 65 of the convex surface 60 of the separator 22 has approximately the same configuration as the surface 60. Although it has been stated in the foregoing that the cross-sectional area of the transition part 38 decreases towards the outlet, it will be understood that this is not a prerequisite of the invention. The important thing is that the fiber suspension has the desired velocity at the outlet aperture 40. This velocity may be different from the aforesaid velocity of 30–40 m/s. In such cases, the separator is correspondingly adapted, by modifying the radius of the curved surface 60 accordingly. The radius of the surface shall preferably be proportional to the square of the velocity.

The transition part does not need to have the zig-zag configuration according to U.S. Pat. No. 4,197,267. An important thing is that the separator 22 is preceded by at least one curve 98 which is counter-directional to the deflecting direction of the curved surface. Also, it is not necessary for the zig-zag configuration or the curve 98 to exhibit sharp corners, as with the illustrated embodiments, but that they may incorporate rounded bends, which may optionally merge immediately one with the other generally sinusoidally, with no intermediate straight parts.

In the illustrated embodiments, a distribution chamber 52 is arranged immediately downstream of the separator 22. It is also possible, however, to arrange a separate distribution or nozzle device, for example as shown in U.S. Pat. Nos. 3,071,822 and 4,099,296 between the separator and the distribution chamber, for distributing the fibers over the continuously moving belt.

The illustrated and described embodiments are not restrictive of the invention, since modifications can be made within the scope of the following claims, without departing from the concept of the invention.

I claim:

1. A method for producing a continuous web of material in which acceptable fibers and reject material suspended in a carrier gas are passed in a transport conduit to a distribution and delivery apparatus through a separator means to remove the reject material through a reject outlet, and to cause the acceptable fibers to advance through an accept outlet to a distribution chamber, in said chamber depositing said acceptable fibers onto one surface of a gas-permeable moving belt to form a web, and removing the carrier gas through a suction box located adjacent the opposite surface of the belt, the improvement comprising the steps of:

providing in said separator means a convex surface having a curvature confronting the flow of the suspension therethrough;

delivering the suspension to the separator means tangential to said convex surface so as to cause said suspension to flow in a path following the curvature of said surface under the influence of the Coanda Effect;

controlling the velocity of the flowing suspension relative to the curvature of the convex surface to cause acceptable fibers to follow said curvature adjacent said surface at one side of a boundary layer spaced radially outward from said convex surface, and to cause reject material in said suspension to be directed away from said curvature to the other side of said boundary layer; and positioning said accept outlet downstream of said convex surface at said one side of the boundary layer, and positioning said reject outlet downstream of said convex surface at the other side of said boundary layer.

2. A method for producing a continuous web according to claim 1, including the step of partitioning the space between the accept outlet and said reject outlet with a wall registering with said boundary layer and substantially parallel to said convex surface substantially downstream from the point of delivering said suspension to said surface.

3. A method according to claim 1 including the step of moving the convex surface in the direction of the suspension.

4. A method according to claim 3 wherein said surface is moved at approximately the same velocity as the flowing fiber suspension.

5. A method according to claim 1 including the step of introducing controlled quantities of thinning air into the suspension before delivering said suspension to said convex surface, said quantities being distributed over the width of said flowing suspension.

6. A method according to claim 5 including the step of creating suction forces of mutually different effect in different sections widthwise of the suction box and transverse to the direction of movement of said belt.

7. A method according to claim 6 including the step of determining the transverse profile of the density of the web produced, and varying the quantities of thinning air and varying the settings of the suction effect in the different sections of the suction box in relation to the determined transverse profile of the density of the web produced.

8. A method according to claim 1 including the step of applying a controlled amount of suction to said reject outlet to cause air and the reject material to flow therethrough.

9. A method according to claim 8 including the step of separating particulate material from the air flowing through the reject outlet and recirculating the air to mix with said suspension upstream of said separator.

10. A method according to claim 1 including the step of supplying air which is at least substantially free of fibers substantially tangentially to said flowing suspension concurrent with its delivery to the convex surface in a path radially outwards of the convex surface.

11. Apparatus for producing a continuous web of material including a preparatory station for fibers; a transport conduit for transporting a suspension of acceptable fibers and reject material in a carrier gas away from said preparatory station; a distribution and delivery apparatus connected to said conduit to receive the flow of said suspension and incorporating in series, a transition part, a separator means, and a pair of alternative outlets comprising a reject outlet for receiving coarse particles and an accept outlet for accepting fine fibers; a distribution chamber connected to said accept outlet; a gas-permeable moving belt operable to pass through said chamber to receive said fine fibers in a continuous web thereon; and suction means in said distribution chamber underlying moving belt to carry away the carrier gas of said suspension;

said separator means including a convex surface having a curvature confronting the flow of said suspension, said transition part directing the suspension to flow tangentially along said convex surface and to follow the curvature thereof due to the Coanda Effect, said accept outlet being positioned downstream of said convex surface adjacent to said surface and said reject outlet being positioned radially outward from said surface, whereby the curved flow path of said suspension along said convex surface causes finer fibers to flow through said accept outlet and causes coarser reject particles to flow through the reject outlet.

12. Apparatus according to claim 11 wherein the communication from said transition part to said separator means comprises a transversely-elongated aperture parallel to the convex surface positioned so that the flow issuing from said outlet has a center line substantially tangential to said surface, said apparatus including an air inlet spaced radially outward of said elongated aperture for admitting fiber-free air to said separator means, said suspension and said fiber-free air forming therebetween a boundary layer generally parallel to said convex surface extending circumferentally from said inlet to said reject outlet, heavier reject particles in said suspension being operable to flow through said boundary layer from said suspension flow into said fiber-free air flow.

13. Apparatus according to claim 12 including a partition wall between the accept outlet and the reject outlet, said partition wall having an adjustable deflection flap projecting circumferentially from said partition in a counterflow direction and terminating in a free edge which is adjustable radially of said convex surface.

14. Apparatus according to claim 13 including means for altering the respective flows of suspension and fiber-free air to thereby change the radial position of the boundary layer therebetween.

15. Apparatus according to claim 14 wherein said adjusting means comprises valves controlling the suction means underlying said gas-permeable belt to control the flow of suspension through said accept outlet.

16. Apparatus according to claim 12 wherein said transition part tapers toward said elongated aperture so as to substantially increase the velocity of the suspension between the entrance and exit ends of said transition.

17. Apparatus according to claim 16 wherein said convex surface is cylindrical and is rotated about its cylindrical axis to provide a surface speed approximately equal to the flow velocity of the fiber suspension.

18. Apparatus according to claim 11 including means mounting said convex surface for circumferential movement in a direction concurrent with the flow of suspension therealong.

19. Apparatus according to claim 18 wherein the convex surface has a radius of curvature of approximately 15 cm when the velocity of the suspension is approximately 40 m/sec.

20. Apparatus according to claim 11 wherein a part of the flow path of said suspension immediately upstream of said convex surface is defined by a curved wall portion which is counterdirectional to the deflecting direction of the convex surface to thereby effect distribution of particles throughout said suspension in advance of the part of the flow path along said convex surface.

21. Apparatus according to claim 11 wherein said apparatus includes a pre-separator upstream of said transition part, said pre-separator having at least one curved convex surface and a reject outlet spaced outwardlY from said surface to separate heavier coarse particles from the suspension flowing through said pre-separator.

22. Apparatus according to claim 11 wherein said distribution chamber overlies said gas-permeable belt, said accept outlet of said separator being elongated parallel to said convex surface and being disposed in the top of said distribution chamber transverse to the direction of travel of said gas-permeable belt.

* * * * *

UNITED STATES PATENT AND TRADEMARK OFFICE

CERTIFICATE OF CORRECTION

PATENT NO. : 4,712,277

DATED : December 15, 1987

INVENTOR(S) : Lennart Gustavsson

It is certified that error appears in the above—identified patent and that said Letters Patent is hereby corrected as shown below:

On the Title Page:

In the heading insert the following:

[30] Foreign Application Priority Data

December 4, 1985 [SE] Sweden.....8505726-3

Signed and Sealed this

Seventeenth Day of May, 1988

*Attest:*

DONALD J. QUIGG

*Attesting Officer*

*Commissioner of Patents and Trademarks*